US007059914B2

(12) United States Patent
Tsai

(10) Patent No.: US 7,059,914 B2
(45) Date of Patent: Jun. 13, 2006

(54) HDMI PLUG CONNECTOR

(75) Inventor: Wen-Hsien Tsai, Taipei Hsien (TW)

(73) Assignee: Advanced Connectek, Inc., Taipei (TW)

( * ) Notice: Subject to any disclaimer, the term of this patent is extended or adjusted under 35 U.S.C. 154(b) by 0 days.

(21) Appl. No.: 10/781,668

(22) Filed: Feb. 20, 2004

(65) Prior Publication Data

US 2005/0186850 A1 Aug. 25, 2005

(51) Int. Cl.
*H01R 33/00* (2006.01)

(52) U.S. Cl. ..... 439/660; 439/417

(58) Field of Classification Search ..... 439/76.2, 439/304, 417, 447, 660
See application file for complete search history.

(56) References Cited

U.S. PATENT DOCUMENTS 4,781,615 A * 11/1988 Davis et al. ..... 439/395
6,171,134 B1 * 1/2001 Lai ..... 439/405
6,206,731 B1 * 3/2001 Kuo ..... 439/610
6,210,230 B1 * 4/2001 Lai ..... 439/610

* cited by examiner

*Primary Examiner*—James R. Harvey
(74) *Attorney, Agent, or Firm*—Chauncey B. Johnson, Esq; Johnson & Associates, P.C.

(57) ABSTRACT

The present invention provides a high definition multimedia interface (HDMI) connector, comprising an insulating housing, a terminal line separator, a metallic shell, a plurality of puncture terminals, a plastic outer shell and a front cover, wherein said terminal line separator consists of the terminal fixing plate and line binder, said puncture terminal is inserted in the insulated housing, the conduction lines are lined up on the line binder and punctured contact with the puncture terminals, followed by placing in the terminal fixing plate to secure the spacing among the puncture terminals, said metallic shell is consisted of the front and rear shell, wherein the insertion portion and the front metallic shell are further interlocked by use of the latch slot at the rear end of the metallic front shell and the latch lug on the insertion portion of the insulated housing, followed by incorporating the metallic rear shell to form a compact metallic unit, said metallic unit is then placed into the plastic outer shell, and the front cover is attached around the insertion opening of the front metallic shell, whereby the buckle on the front cover interlocks with a notch on the plastic outer shell, and the metallic unit is solidified inside the plastic outer shell, and the assembly of the HDMI plug connector is completed.

10 Claims, 7 Drawing Sheets

C

C aBC aBc abC abc

HDMI PLUG CONNECTOR

BACKGROUND OF THE INVENTION

1. Field of the Invention

The present invention relates to a HIGH DEFINITION MULTIMEDIA INTERFRACE (HDMI) connector. Specifically, the present invention relates to a small HDMI connector used in digital televisions, DVD players, deck-top boxes or video signal converters and other digital Audio/Video (AV) products.

2. Description of the Related Prior Art

Nowadays, Liquid Crystal Displays (LCDs) have become the output device of choice for use in AV products. The increasing role of LCDs in AV products such as PC monitors and TV displays, etc. has created a need for connectors capable of transmitting digital signals between the former and the latter. The enhanced HDMI device of the present invention is a connector capable of transmitting digital signals between AV products, such as PC monitors and TV displays, and LCDs.

A HDMI device is a transmission interface utilized for transmitting high definition multimedia digital signals, including high fidelity images and multi-channel audio signals. The earlier HMDIs were disclosed by AV manufacturers, such as HITACHI, Panasonic, Philips, Sony, Silicon Image, Thomson and Toshiba. These manufacturers established the use of HDMIs based on the standard specification of Digital Visual Interface (DVI) technology, which protects against signal detection and privacy by encoding signals at the transmitting end and decoding signals at the receiving end. Although the DVI technology improved the resolution and quality of pictures on LCD screens and protected against detection and piracy, however, it lacked the ability to transmit digital audio signal and thus required users to incorporate an additional line or use traditional AV terminal for signal transmission. Having an additional line to compensate for lack of signal transmission capabilities is not only of compatibility concerns when used with personal computers but is chaotic when used with family theater electronics, whose usage have greatly increased among consumers. Additional lines connected to family theater electronics substantially increase the number of installation components and further increase the prices of these products. Furthermore, using DVI technology with smaller electronic devices such as digital video cameras would be cumbersome.

The HDMI connector of this invention is not only in compliance with the standard specification of the aforementioned generic DVI technology, but its design is capable of both transmitting digital signal transmission and transmitting uncompressed signal data. Furthermore, the present HDMI design enhances compatibility with various video specification formats, and when used with various AV consumer products provides video signals of both high quality and high fidelity. In addition, this device is smaller as compared with prior art connectors, this device uses less cable or connection for transmitting uncompressed data and this device is capable of protecting against signal detection and piracy by encoding signals at the transmitting end and decoding signals at the receiving end. Furthermore, this device provides two-way communication for digital appliances, such as TV, DVD player, deck top box (signal converter) and small connectors of other digital AV products and this device can be conveniently installed inside different AV products, thus reducing the interface connector volume significantly.

Based on the aforementioned paragraphs above, the HDMI connector of the present invention will no doubt become a mainstream connector of the AV industry. We expect this connector to become the first connector based on AV standard specification technology, which will be supported by both software suppliers and system providers of consumer electronics.

SUMMARY OF THE INVENTION

An object of this invention is to disclose a HDMI plug connector capable of utilizing a terminal line separator to fix punctured terminals contacts and conductors contacts, and capable of maintaining an equal space between each terminal to increase its stability and provide a stable signal communication.

Another object of this invention is to disclose a HDMI plug connector with a front shell and a rear shell adapted to cover an insulated housing, and capable of performing a quick engagement through the formation of its mating structure comprising protrusions and latch holes on a front shell and a rear shell respectively.

Yet, another object of this invention is to disclose a HDMI plug connector with a plastic outer shell and a front cover adapted to accommodate a main portion of the integration body of a front shell and a rear shell, and capable of performing a quick engagement through the formation of its mating structure comprising notches and buckles on a front and a rear shell respectively.

Still, another object of this invention is to disclose a HDMI plug connector comprising of an insulated housing, a terminal line separator further consisting of a terminal fixing plate and a line binder, a metallic cover shell, a plurality of punctured terminals, a plastic outer shell and a front cover, and which uses a punctured conductive contact in lieu of conventional soldering to alleviate environmental contamination problem.

Yet still, another object of this invention is to disclose an assembling process where punctured terminals are inserted in the insulated housing, conduction lines are lined up on a line binder and punctured with the punctured terminals, and a terminal fixing plate is placed to secure the spacing amongst the puncture terminals.

Further, another object of this invention is to disclose an assembling process where an insulated housing and a terminal line separator are combined as an assembled portion and inserted through an insertion opening of a front metallic shell, where both the assembled portion and the front metallic shell are then interlocked by the use of latch slots at the rear end of the front metallic shell and latch lugs on the insertion portion of the insulated housing, and where the rear metallic shell is incorporated in the assembled combination by the use of protrusions on the front metallic shell and latch holes on the rear metallic shell to form a compact metallic unit.

Still further, another object of this invention is to disclose an assembling process where after combining the aforementioned assembled portion with the rear metallic shell, inward projections located on both sides of the metallic shell are fitted to prevent the front metallic shell from further movement during the assembling process.

A final object of this invention is to disclose an assembling process where the metallic unit is placed into a plastic outer shell, the front cover is attached around the insertion opening of the front metallic shell, buckles on the front cover interlock with notches on the plastic outer shell and the assembly of the HDMI plug connector is completed.

BRIEF DESCRIPTION OF THE DRAWINGS

Other aspects of this invention will become more apparent from the following detailed description when taken in conjunction with the accompanying drawings, in which.

DESCRIPTION OF THE PREFERRED EMBODIMENT

Figure 1:
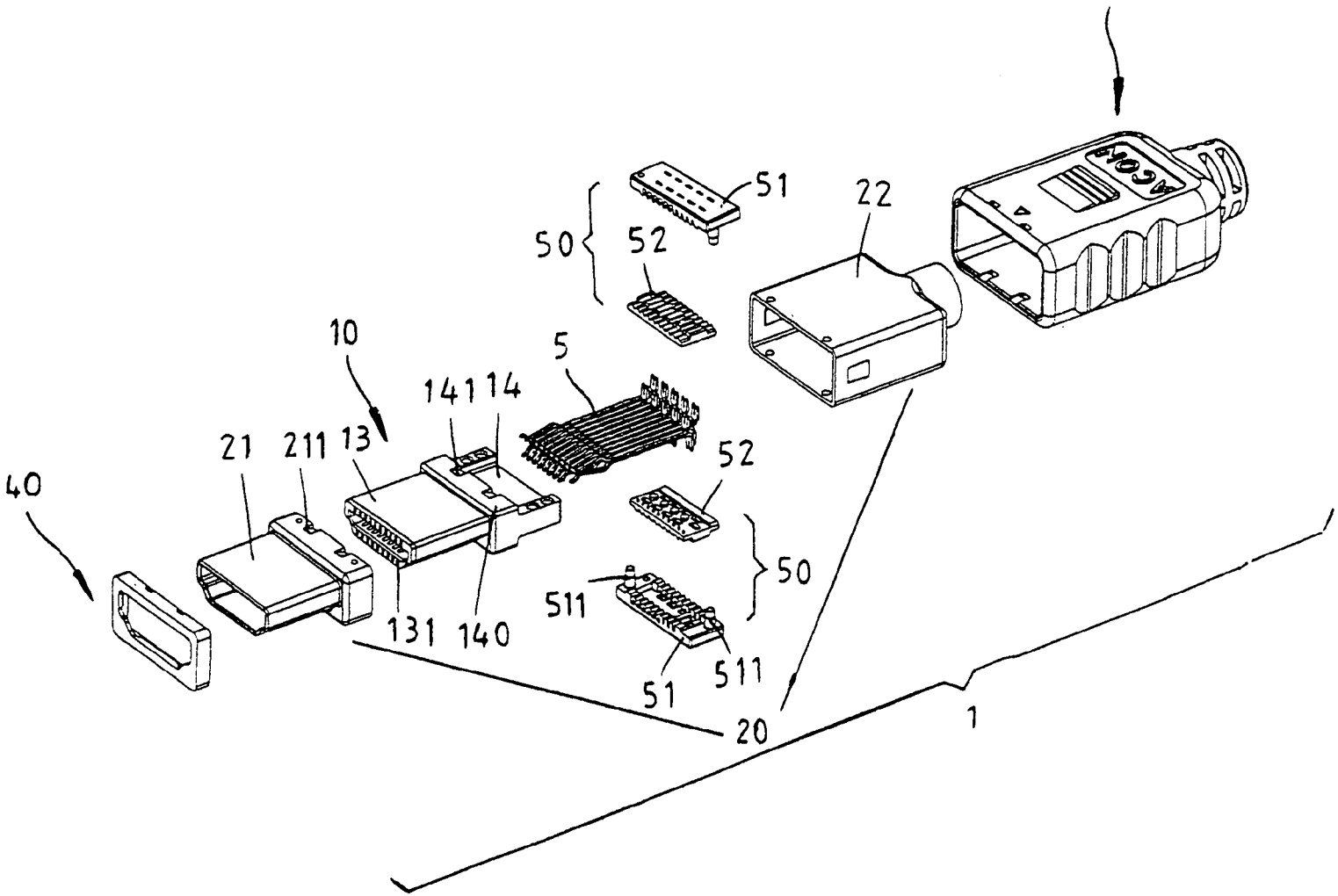
FIG. 1 is an exploded view of the HDMI plug connector in accordance with the present invention.

FIG. 1 illustrates a HDMI plug connector 1 comprising an insulated housing 10, a set of metallic cover shells 20, a plastic outer shell 30, and a front cover 40. The structure of the insulated housing 10 consists of an insertion, front-end portion 13 and a retaining rear-end platform 14; furthermore, the insulated housing 10 also provides an insertion holder for holding corresponding terminals 5. The insertion front-end portion 13 is a flat projected body with two rows of terminal receiving slots 131 aligned at the top side and the bottom side of said front-end portion 13, and extending from the insertion front-end portion to the retaining rear-end platform. The insertion front-end portion 13 utilizes a curved contour shape at the bottom of both sides of its projected body to form a design with sound structural integrity.

Still referring to FIG. 1, the retaining platform 14 is formed mainly of a horizontal T shape block combined with the insertion front 13 and a plurality of protrusions 141 are furnished on top and bottom ends for interlocking with the latch slots 211 on the front metallic shell. The flat portion of the horizontal T shape block forms the retaining platform 14 and top and bottom sides of the retaining platform 14 provide a seat for a terminal line separator 50. A plurality of concave slots located on top and bottom sides of a positioning block 15 located on either side of the platform 14 are furnished for inserting positioning poles 511 positioned on a terminal fixing plate 51, which forms a portion of the terminal line separator 50.

Figure 4:
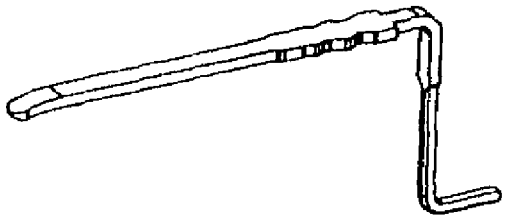
FIG. 4 is a front view of a terminal of the HDMI plug connector in accordance with the present invention.
Figure 4:
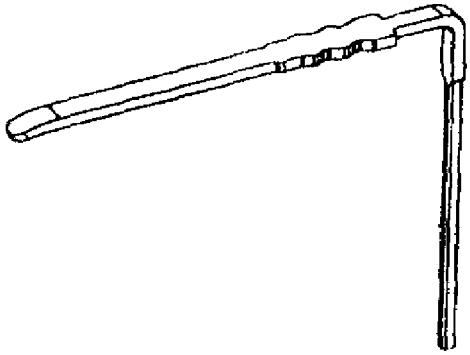
Figure 5:
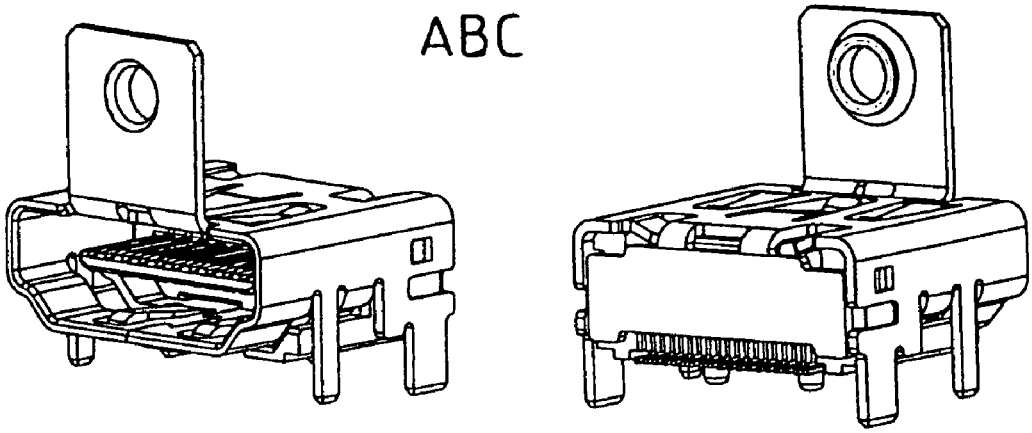
FIG. 5 is a rear view of a terminal line separator of the HDMI plug connector in accordance with the present invention.
Figure 6:
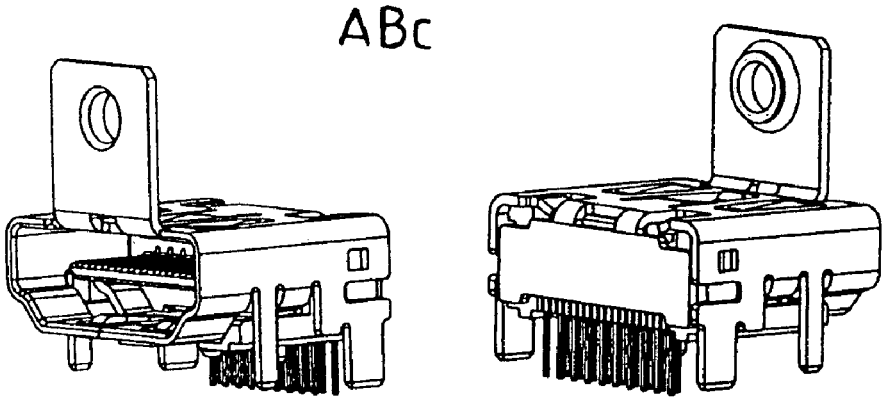
FIG. 6 is a second stage assembled view of the HDMI plug connector in accordance with the present invention.
Figure 7:
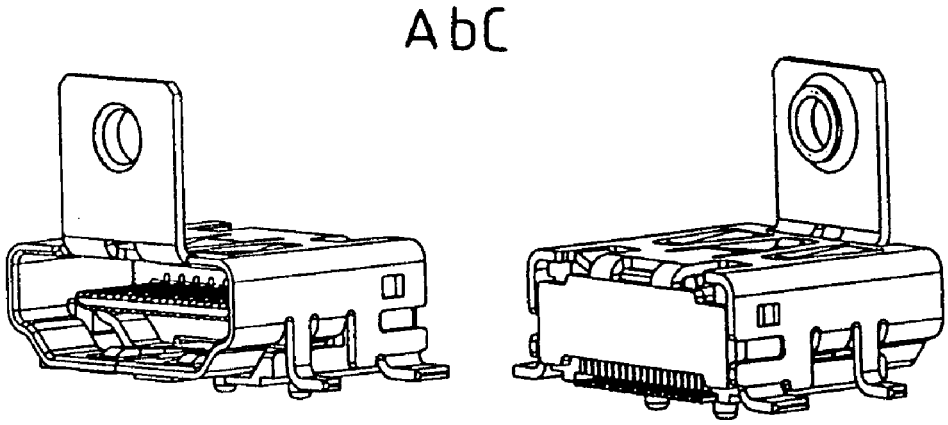
FIG. 7 is a third stage assembled view of the HDMI plug connector in accordance with the present invention.
Figure 8:
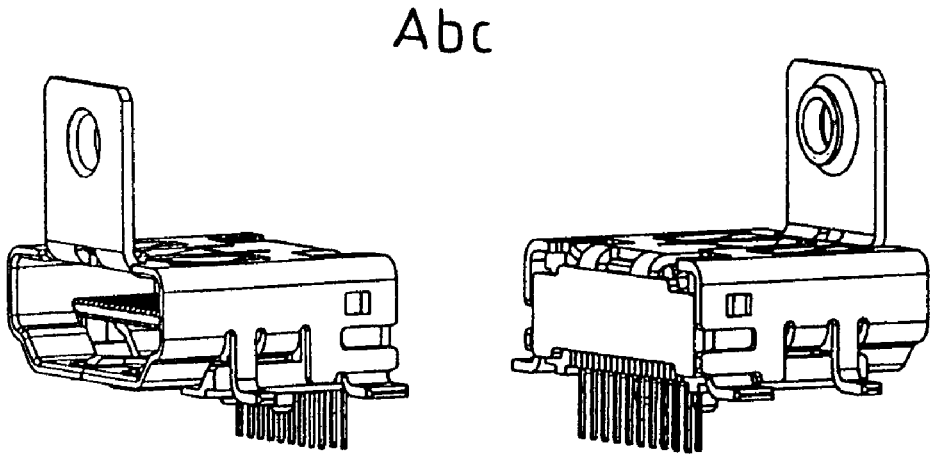
Figure 9:
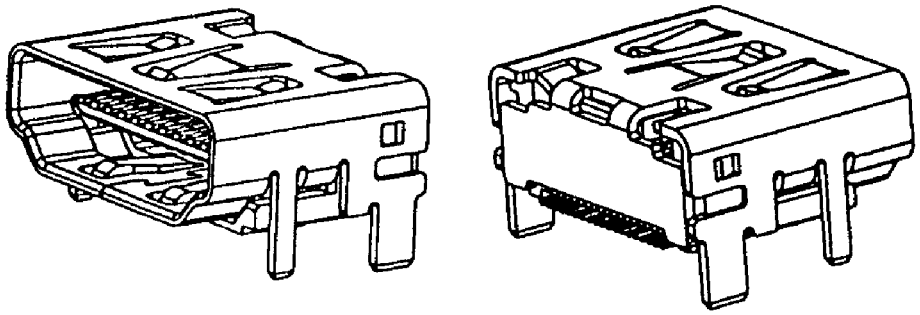
Figure 10:
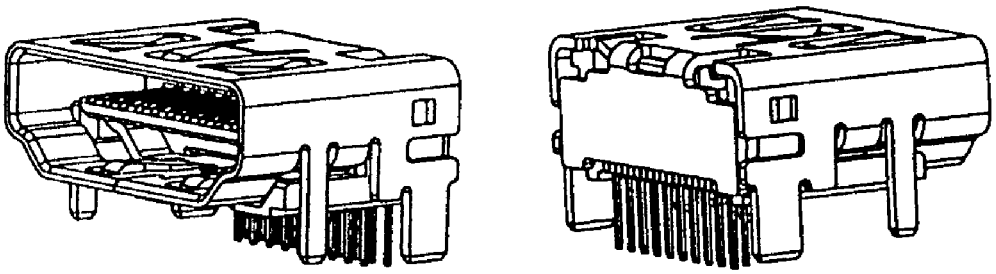
Figure 11:
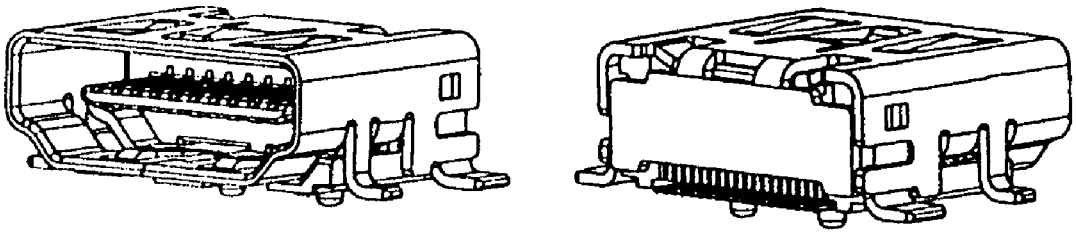
Figure 12:
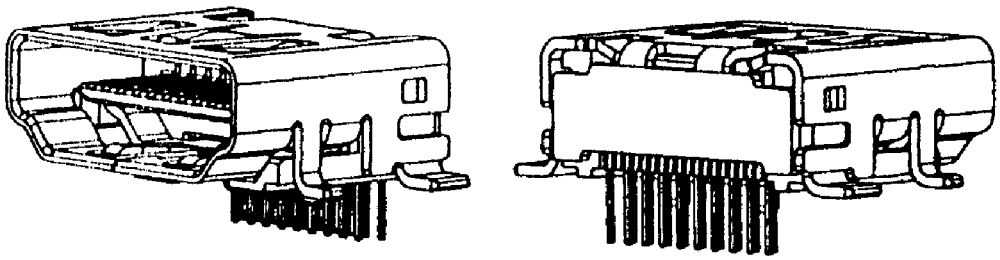

Referring to FIG. 4 and FIG. 5, the terminal line separator 50 consists of the terminal fixing plate 51 and a line binder 52 mated with said fixing plate in a convex and concave area. A plurality of ribs 522 having different width are furnished on an inner side surface near end sections of both long sides of the line binder 52. The ribs are equally spaced and said spacing corresponds to the spacing of a set of protrusions 512 located on the terminal fixing plate 51, and said protrusions are designed to firmly interlock with said ribs having step-like characteristics when the line binder 52 is fitted with the fixing plate 51 or vice versa.

As further illustrated in FIG. 4 and FIG. 5, a plurality of arc portions 523 are formed between the ribs 522 on both sides of the line binder 52. Positioning slots 524 are furnished with insertion positions fed through the arc portions 523 and the ribs 522 for accommodating punctured terminals 5, wherein the positioning slots 524 interlaces with the insertion positions of the punctured terminals 5. A projection 525 placed on the long side end of the outside surface of the line binder 52 has the same height as the convex poles 526 placed between two rows of positioning slots 524, and the height of the projection 525 approximately equals the thickness of the puncture terminals 5.

Still referring to FIG. 4 and FIG. 5, a plurality of the fixing protrusions 512 of variable thickness are aligned in a row with identical spacing 515 formed therein on an inner side surface near end sections of both long sides of the terminal fixing plate 51 for receiving conduction lines. Each fixing protrusion 512 extending sideward from the top has an arrow-like profile and a plurality of fixing insertion slots 514 are furnished on a concave section 513 between the fixing protrusions 512 of the terminal fixing plate 51 for inserting punctured terminals 5. The positions of the insertion slots 514 are interlaced and correspond to the positions of the punctured terminals 5. Two positioning poles 511 are provided diagonally on each short side of the fixing protrusions 512 and are tightly mated with the concave slots 151 on the insulated housing 10.

Referring to FIG. 1 through FIG. 7, the metallic covering shell 20 is comprised of a front portion and a rear portion. The appearance of the front metallic shell 21 is similar to the insertion front 13 of the insulated housing 10, so as to precisely receive the insertion front 13 when assembled, and the front metallic shell 21 is furnished with a plurality of latch slots 211 and with a plurality of lugs 212 on top and bottom of its long side surface. The latch slots 211 interlock with the protrusions 141 on a retaining platform 14 of the insulated housing 10 and the lugs 212 interlock with latch holes 221 on the rear metallic shell 22.

The rear metallic shell 22 with a rectangular body having a front hollowed opening attaches a hollowed cylindrical tube at its rear end to provide a sufficient inner space for receiving conduction lines. The positions of the latch holes 221 furnished on the front end of the rear metallic shell 22 correspond with the positions of the lugs 212 on the front metallic shell 21. Stops 222 furnished on a suitable spot on both sides of a narrow plate of the rear metallic shell 22 may prevent further movement by the use of inward slanted stops 222 capable of thrusting against side edges of the rectangular section of an accommodating front metallic shell 21.

Still referring to FIG. 1 through FIG. 7, the plastic outer shell is adapted for receiving the rear metallic shell 22 incorporated with the front metallic shell 21, which firmly houses the rear metallic shell 22. There is a plurality of notches 31 on the front end of the top and bottom sides of the plastic outer shell 30. The number and positions of the notches 31 correspond directly with the number and positions of buckles 41 on the front cover 40, which has an opening similar to that of an insertion portion 11 and the front metallic shell 21.

Figure 3:
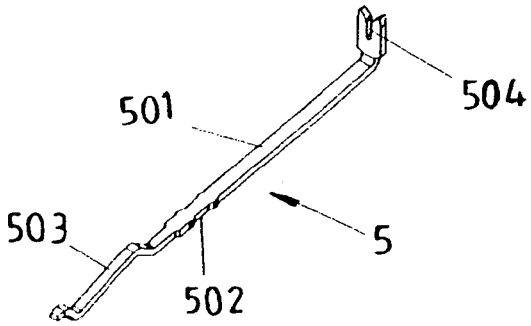
FIG. 3 is a perspective view of a conduction terminal of the HDMI plug connector in accordance with the present invention.

Referring to FIG. 3, the punctured terminals 5 are formed by punching a flexible conductive material into a strip, whereby a base 501 extends to the two ends of the punctured terminals to form one end as an inserting contact portion and the other end as a conduction line contact portion. The inserting contact portion has a plurality of tooth spikes 502, which are used as fixing terminals and on the opposite side of the tooth spikes a flexible contact 503 is formed with a curvature at its end. Furthermore, at the end of the conduction line contact portion there is formed a punctured line 504 having a U-shape, which is used for easy puncturing of conduction lines.

The assembling process is a preferred embodiment of the present invention and is carried out from inside out. The first step of the assembling process requires introducing the conduction lines into the plastic outer shell 30 and the rear metallic end shell 22, and followed by inserting the punctured terminals 5 into the terminal position slots 131, which are positioned inside the insertion front portion 13 of the insulated housing 10. The puncture line holders 504 of the punctured terminals 5 are then inserted into the positioning slots 524 of the line binder 52 in the terminal line separator 50, which is then placed on the retaining platform 14 of the insulated housing 10 for the conduction lines to be punctured by the punctured line holders 504 of the punctured terminals 5.

The conduction lines are routed through the arc portion 523 of the line binder 52 and then the terminal fixing plate 51 is firmly mated with the line binder 52 to tightly bind the punctured line holders 504 of the punctured terminals 5, and the conduction lines are tightly kept within the terminal line separator 50 through the binding action of the line binder 52 and the fixing plate 51. When the positioning poles 511 of the terminal fixing plate 51 are mated with the concave slots 151 of the insulating housing 10, the latter is fastened by the terminal line separator 50 and the terminals are held tightly within. The foregoing description completes the first step of the assembling process illustrated by FIG. 2 of the present invention.

Figure 2:
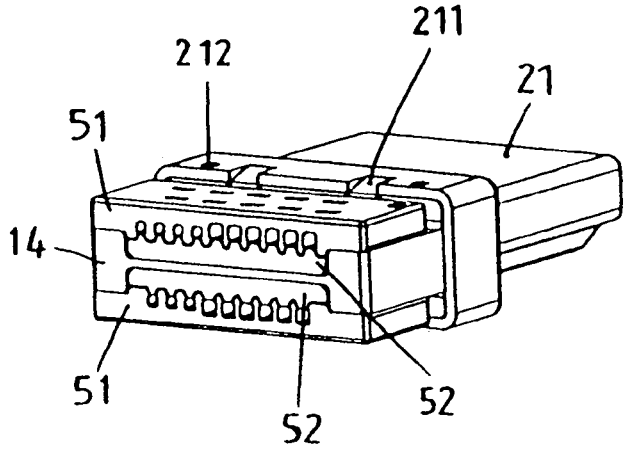
FIG. 2 is a perspective view of an insulated housing of the HDMI plug connector in accordance with the present invention.

The second step of the assembling process begins with combining the front metallic shell 21 with the assembled portion produced through the first assembling process step illustrated in FIG. 2. That is, the latch slots 211 on the rectangular section of the front metallic shell 21 is incorporated with the latch lugs 141 of the retaining platform 14 of the insulated housing 10. The combined unit (the front metallic shell/the assembled portion illustrated in FIG. 2) is then inserted into the rear-end portion of the metallic shell 22, and a cable wire is introduced through the rear metallic shell's cylindrical end.

Next, the lugs 212 on the rectangular section of the front metallic shell 21 are latched with latch holes 221 on the rear metallic shell 22. Therefore, the front metallic shell 21 and the rear metallic shell 22 are prevented from further movement during assembling operation by the use of inward slant stops 222 located on both sides of the rear metallic shell 22. The inward slant stop 222 thrust against the side edges of the rectangular section of the accommodating front metallic shell 21 to prevent said forward movement. The foregoing description completes the second step of the assembling process illustrated in FIG. 6 of the present invention.

The third and final step of the assembling process begins by engaging the front cover 40 around the previously assembled front metallic shell 21 in the metallic housing 20 to retain the rectangular section of the front metallic shell 21. The assembled portions are then moved into the plastic outer shell 30 where a cable wire is introduced through the latter's cylindrical end. Finally, the whole metallic housing assembly 20 is fixed firmly in the plastic outer shell 30 by the use of the buckles 41 located on the front cover 40, which latch with the notches 31 on the plastic outer shell 30. The foregoing description completes the third and final step of the assembling process and results in an assembled connector of the present invention illustrated in FIG. 7.

From the above description it is understood that the HDMI connector of the present invention is thus fabricated and assembled through a multiple locking mechanism to form a rigid and compact structure in compliance with the strict requirements. Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. A HDMI plug connector comprising an insulated housing, a terminal line separator, a plurality of punctured terminals, a plastic outer shell, and a front cover, wherein the terminal line separator further consists of a terminal fixing plate and a line binder, the insulated housing and the terminal line separator are combined as an assembled portion and inserted through an insertion opening of a front metallic shell, the assembled portion and the front metallic shell are further interlocked by use of latch slots at the front metallic shell's rear end and latch lugs on an insertion portion of the insulated housing, and a rear metallic shell is incorporated therein by use of protrusions on the front metallic shell, and latch holes on the rear metallic shell to form a compact metallic unit.

2. The HDMI plug connector according to claim 1, wherein the metallic unit is placed into the plastic outer shell, the front cover is attached around the insertion opening of the front metallic shell, buckles on the front cover interlock with notches on the plastic outer shell, the metallic unit is solidified inside the plastic outer shell, and the HDMI plug connector is assembled.

3. The HDMI plug connector as in claim 2, wherein a retaining platform is formed mainly by a horizontal T shape block combined with an insertion front, a plurality of protrusions are furnished on top and bottom ends for interlocking with the latch slots on the front metallic shell, a flat portion of the horizontal T shape block forms the retaining platform, top and bottom sides of the retaining platform provide a seat for the terminal line separator, and a plurality of concave slots positioned on top and bottom sides of a positioning block at both sides of the retaining platform are furnished for insertion of positioning poles positioned on the terminal fixing plate, which forms a portion of the terminal line separator.

4. The HDMI plug connector as in claim 1, wherein the terminal fixing plate and line binder are mated with each other in a convex and a concave area, a plurality of ribs having different width are furnished on an inner side surface near end sections of both long sides of the line binder, the ribs are equally spaced and the spacing correspond to the spacing of a set of protrusions located on the terminal fixing plate, and the protrusions are designed to firmly interlock with the ribs having step-like characteristics when the line binder is fitted with the fixing plate or vice versa.

5. The HDMI plug connector according to claim 3, wherein a projection placed on a long side end of an outside surface of the line binder has the same height as convex poles, which are placed between two rows of positioning slots, and the height of the projection approximately equals the punctured terminals thickness.

6. The HDMI plug connector according to claim 1, wherein a plurality of fixing protrusions of variable thickness are aligned in a row with identical spacing formed therein on an inner side surface near end sections of both long sides of the terminal fixing plate for receiving conduction lines, each fixing protrusion located on top and extending sideward forms an arrow-like profile, plurality of fixing insertion slots are furnished on a concave section between the fixing protrusions of the terminal fixing plate for inserting the punctured terminals, positions of the insertion slots are interlaced and correspond to positions of the punctured terminals, and two positioning poles are provided diagonally on each short side of the fixing protrusions and are tightly mated with concave slots on the insulated housing.

7. The HDMI plug connector according to claim 1, wherein the front metallic consists of a front and a rear portion, the appearance of the front metallic shell is similar to an insertion front of the insulated housing to precisely receive the insertion front when assembled, front metallic shell is furnished with a plurality of latch slots and with a plurality of lugs located on top and bottom of its long side surfaces, latch slots interlock with the protrusions on a retaining platform of the insulated housing and lugs interlock with the latch holes on the rear metallic shell.

8. The HDMI plug connector according to claim 1, wherein the rear metallic shell with a rectangular body having a front hollowed opening attaches a hollowed cylindrical tube at its rear end to provide a sufficient inner space for receiving conduction lines, latch holes position furnished on the front end of the rear metallic shell correspond with lugs position on the metallic shell, and stops furnished on a suitable spot on both sides of a narrow plate of the rear metallic shell are capable of preventing further movement by using inward slanted stops, which are capable of thrusting against the side edges of a rectangular section of an accommodating portion of the front metallic shell.

9. The HDMI plug connector according to claim 1, wherein the plastic outer shell is adapted for receiving the rear metallic shell incorporated with the front metallic shell which firmly houses the rear metallic shell, a plurality of notches are furnished on the front end of the plastic outer shell top and bottom sides, and the notches positions and number correspond directly with that of buckles on the front cover.

10. The HDMI plug connector according to claim 1, wherein the front cover has an opening similar to an insertion front portion and the front metallic shell, which is capable of confining the front portion of the metallic shell and thrust against the front metallic shell at a rectangular section of the shell, and a plurality of buckles are furnished on top and bottom sides of the front cover frame.

* * * * *